US006406137B1

(12) United States Patent
Okazaki et al.

(10) Patent No.: US 6,406,137 B1
(45) Date of Patent: Jun. 18, 2002

(54) INK-JET PRINT HEAD AND PRODUCTION METHOD OF INK-JET PRINT HEAD

(75) Inventors: Takeshi Okazaki, Sagamihara; Yutaka Koizumi, Yokohama; Kiyomi Aono, Kawasaki; Tsutomu Abe, Isehara; Kouichi Omata, Kawasaki; Hiroki Tajima, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/465,386

(22) Filed: Dec. 17, 1999

(30) Foreign Application Priority Data

Dec. 22, 1998 (JP) ..... 10-365636
Dec. 7, 1999 (JP) ..... 11-348116

(51) Int. Cl.[7] ..... B41K 2/18
(52) U.S. Cl. ..... 347/93; 347/89
(58) Field of Search ..... 347/33, 89, 61, 347/93, 70; 346/75

(56) References Cited

U.S. PATENT DOCUMENTS 4,019,188 A * 4/1977 Hochberg et al. ..... 346/75
4,680,696 A * 7/1987 Ebinuma et al. ..... 346/75
5,870,116 A * 2/1999 Kyoshima ..... 347/33
5,956,062 A * 9/1999 Omata et al. ..... 347/89
6,152,559 A * 11/2000 Kojima ..... 347/89

* cited by examiner

*Primary Examiner*—Anh T. N. Vo
(74) *Attorney, Agent, or Firm*—Fitzpatrick, Cella, Harper & Scinto

(57) ABSTRACT

A connector cap 56 having connection openings 56A and 56B provided respectively corresponding to the other ends of ink passages 46 and 54 and a communication passage 56R for communicating the connection opening 56A with the connection opening 56B is provided detachably to the other ends of the ink passages 46 and 54.

24 Claims, 6 Drawing Sheets

INK-JET PRINT HEAD AND PRODUCTION METHOD OF INK-JET PRINT HEAD

This application is based on patent application Ser. Nos. 10-365636 (1998) filed: Dec. 22, 1998 in Japan and 11-348116 (1999) filed Dec. 7, 1999 in Japan, the content of which is incorporated hereinto by reference.

BACKGROUND OF THE INVENTION

1. Field of the Invention

The present invention relates to an ink-jet print head for ejecting a liquid used for printing to a printing surface of a printing medium to perform printing operation and a production method of the ink-jet print head.

2. Description of Prior Art

An ink-jet printing apparatus is generally provided with a print head for ejecting an ink as a liquid used for printing. The print head, for example, as shown in FIG. 4, is fixed to an apparatus main body part 2 in the ink-jet printing apparatus through a support plate 8. The print head comprises an ink ejection part 12 having a plurality of relatively small ink ejection openings for ejecting ink droplets ID to the printing surface of paper Pa and a printed circuit board 10 provided on the support plate 8 for supplying drive control signals to heaters provided in respective ink flow passages communicating with the respective ink ejection openings of the ink ejection part 12.

A connection terminal 10A of the printed circuit board 10 is connected to a connector 4 of the apparatus main body part 2 outputting a drive control signal group. Further, transportation direction of paper Pa is, for example, a direction along a nearly perpendicular direction to the paper surface.

In the ink ejection part 12 one connection opening 12*a* communicating with a common liquid chamber for distributing ink to respective ink flow passages is connected to an end of an ink passage 16 constituting part of a component of a liquid supply device for supplying ink to the print head. Further, in the ink ejection part 12 the other connection opening 12*b* communicating with the common liquid chamber is connected to an end of an ink passage 18 constituting part of a component of the liquid supply device.

The other ends of the ink passages 16 and 18 are respectively connected to a head side joint part 14 engaged with a main body side joint part 6. The main body side joint part 6 has an ink passage supplied with ink from the apparatus main body part 2.

The head side joint part 14 has a filter containing chamber communicated with an inner peripheral part of the other end of the ink passage 16, and a filter containing chamber communicated with an inner peripheral part of the other end of the ink passage 18. Smaller end diameters of the tapered filter containing chambers are respectively the same as diameters of the inner peripheral parts, and larger end diameters thereof are almost the same as diameters of filters as straining members contained. Each filter is to collect foreign matters such as dust in the ink.

SUMMARY OF THE INVENTION

In the thus constructed print head, there is a fear that foreign matters such as cutting debris or dust in the production process exist in the ink passages.

In the print head, for example, as shown in FIG. 5, in which a plurality of ink flow passages 27 are formed by adjacent partition walls 22 with predetermined intervals provided in parallel to each other in the common liquid chamber 28, the print head is of a type in which electrothermal conversion elements 24 used for ejecting ink are provided in each ink flow passage 27 to eject ink in the direction shown by the arrow, namely, along an extension direction of the ink passage 27 through the ejection opening 26. In this type of print head, when the common liquid chamber 28 or the ink flow passage 27 is constructed by a method of cutting such as cutting, cutting debris 23 is generated, which may exist at an inlet part (upstream side end part) of the ink flow passage 27 or in the common liquid chamber 28.

Further, also in the print head of a type as shown in FIG. 6, in which in its orifice plate OP, an ejection opening 26' is provided at a position opposing each electrothermal conversion device 24' provided in each ink flow passage 27' , and ink is ejected through the ejection opening 26' , in the direction shown by the arrow, namely in a direction opposing the electrothermal conversion device 24', similarly to the above, there is a possibility that cutting debris 23 generated in the production of the print head remain in each ink flow passage 27' and the common liquid chamber 28 of the completed head.

Yet further, there is known, as shown in FIGS. 7 and 8, a print head having ejection openings 26 in an order of thousands. In FIGS. 7 and 8, same components as those shown in FIGS. 4 and 5 are indicated with the same reference numbers, and detailed description there is omitted.

In the print head as shown in FIGS. 7 and 8, the ink ejection part 12 comprises a substrate 13 having electrothermal conversion devices 24 corresponding to respective ink flow passages 27 and electrically connected to the printed circuit board 10, and a top plate 11 respectively having ejection openings 26 communicating with the respective ink flow passages 27.

In such a print head, there may be a case that a relative position of the electrothermal conversion device 24 at the substrate 13 side is shifted with respect to the ink flow passage 27 due to a difference in thermal expansion coefficient between a material of the top plate 11 and that of the substrate 13.

As a method for eliminating this problem, a method is proposed in which to improve a problem of thermal contraction during processing of the print head, the top plate 11 which forms the ink flow passage 27 in cooperation with the substrate 13 is, for example, insert formed with a stainless pipe 31 or the like.

In the print head thus fabricated by the above method, to obtain a structure capable of ink supply, the stainless pipe 31 is provided with a drilling hole 29 communicating with the common liquid chamber 28 at an appropriate interval, utilizing the stainless pipe 31 as a passage 33 for flowing ink in the stainless pipe 31.

Therefore, cutting debris 23 generated during the machining may exist at. the inlet of the ink flow passage 27 and in the common liquid chamber 28.

Such a foreign matter generated during machining may disturb ink flow at the inlet part of the ink flow passage 27 or in the common liquid chamber 28 and result in degradation of ink ejection performance. This leads to a reduction of yield of the produced print heads.

In order to remove cutting debris existing inside the print head just described, it is necessary to clean the inside of the print head. Further, in order to perform the cleaning more certainly, it is preferable to construct the print head such that the route for discharging cutting debris from the inside of the print head to the outside be appropriately selected depending on the size or the like of cutting debris existing in the inside.

It is an object of the present invention to provide an ink-jet print head capable of efficiently discharging cutting debris or the like from the inside of the print head to the outside, in which, in the production of the print head, a process is employed for cleaning the inside of the print head.

A further object of the present invention is to provide an ink-jet print head having a configuration capable of performing cleaning of the inside of the print head with ease.

In accordance with the present invention which is proposed to attain the above objects, there is provided a production method of an ink-jet print head comprising a plurality of ejection openings for ejecting a liquid, liquid flow passages for supplying the liquid to each of the plurality of ejection openings, a common liquid chamber communicating with the plurality of liquid flow passages, a first liquid passage communicating with one end of the common liquid chamber and having a diameter larger than that of the liquid flow passage, a second liquid passage communicating with the other end of the common liquid chamber and having a diameter larger than that of the liquid flow passage, and an openable/closable opening part having an opening diameter larger than that of the liquid flow passage provided halfway in the second liquid passage.

The print head is characterized in that the print head is produced employing a process for screening a foreign matter larger than the opening diameter of the liquid flow passage generated in the liquid passages, the liquid flow passages, or the common liquid chamber by a difference of opening diameter of the liquid flow passages.

Further, the ink-jet print head according to the present invention is characterized by comprising a plurality of nozzles for ejecting an ink, ink flow passages for supplying the ink to the plurality of nozzles, a common liquid chamber communicating with the plurality of ink flow passages, a first ink passage provided with a first filter at the other end side of a communicating part communicating with one end of the common liquid chamber, and a second ink passage provided with a second filter at the other end side of a communicating part communicating with the other end of the common liquid chamber, wherein an openable/closable opening having an opening diameter larger than that of the ink flow passage is provided halfway in the second ink passage.

Further, the present invention is characterized by comprising a first passage provided with arranged liquid ejection openings for ejecting a liquid used for printing communicating with one end side in a liquid ejection part for conducting the liquid into the liquid ejection part, a second passage communicating with the other end side of the liquid ejection part for supplying the liquid to the liquid ejection part or conducting out the liquid inside the liquid ejection part, and open/close means provided halfway in the second passage for communicating inside of the second passage selectively with the outside to discharge the liquid in the second passage to the outside.

As apparent from the above description, according to the print head and the production method of the ink-jet print head, since open/close means for selectively communicating the inside of the second ink passage with the outside is provided halfway in the second ink passage to discharge the liquid in the second ink passage, an unnecessary foreign matter remaining in the ink flow passage can be removed certainly and simply from the inside of the ink flow passage.

Since a cleaning liquid discharge part provided halfway in the ink passage is constructed to have an opening diameter larger than that of the ink flow passage communicating with the ink ejection opening, in performing treatment of foreign matter existing inside the print head, a foreign matter that can be discharged from the ink flow passage and a foreign matter of a size that cannot be discharged from the ink flow passage are separated by a difference in opening diameter, it is possible that the large foreign matter is discharged to the outside through the ink flow passage, and the small foreign matter is certainly discharged from the ink flow passage.

Further, foreign matter in the ink flow passage is even more certainly discharged to the outside by sucking from the ejection opening side.

A connector cap or a select valve provided at the cleaning liquid discharge part simplifies the configuration to communicate the ink passage or cut off the ink passage to release it to the outside according to the processing to be performed by the print head.

In cleaning of the print head, by vibrating the print head, since foreign matter can be effectively peeled off from the inner wall part of the print head and efficiently moved along with the cleaning liquid, cleaning effect is improved and, therefore, number of defective print heads causing non-ejection is reduced, and yield in the production of the print head is improved.

The above and other objects, effects, features and advantages of the present invention will become more apparent from the following description of embodiments thereof taken in conjunction with the accompanying drawings.

DESCRIPTION OF PREFERRED EMBODIMENTS

Figure 1:
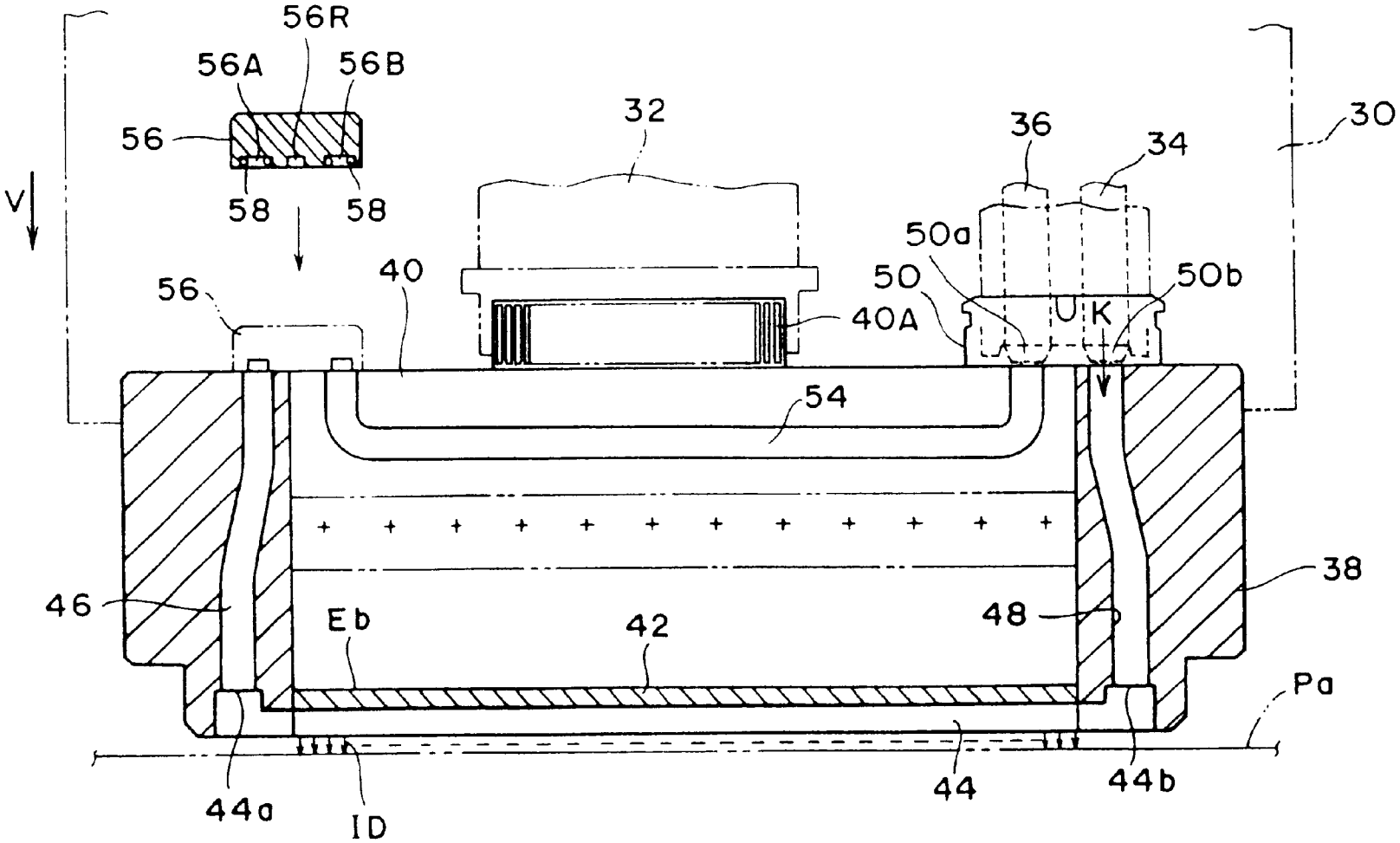
FIG. 1 is a schematic diagram showing a construction example of the ink-jet print head according to the present invention.

FIG. 1 is a schematic diagram showing an example of print head according to the present invention. In FIG. 1, the print head comprises an ink ejection part 44 having a plurality of ink ejection openings for ejecting an ink droplet ID to a printing surface of printing paper Pa when it is loaded on a printing apparatus, and a printed circuit board 40 disposed on a support member used for mounting the print head on the printing apparatus for supplying a drive control signal group to a drive board 42 for driving the ink ejection part 44. The printed circuit board 40 is provided with connection terminals 40A to be connected with a connector 32 for signal transmission when the print head is equipped on the printing apparatus.

Further, the printed circuit board 40 is electrically connected to the drive board 42, for example, by a wire connection Eb such as wire bonding. The drive board 42 is provided with heaters as electrothermal conversion devices corresponding to respective ink flow passages; communicating with respective ink ejection openings of the ink ejection part 44, which will be described later.

The surface opposing paper Pa of the ink ejection part 44 is provided with a plurality of ink ejection openings arranged along a nearly perpendicular to a transportation direction of paper Pa. The ink ejection openings are formed at predetermined intervals along the entire width of printing area of paper Pa. One end of each ink flow passage is communicated with a common liquid chamber for distributing an ink to each ink flow passage.

The ink ejection part 44 has connection openings 44*a* and 44*b* respectively at its both ends communicating with the inside of its common liquid chamber respectively at both ends. One connection opening 44*a* of the ink ejection part 44 is connected to one end of an ink passage 46 forming a part of construction of the liquid supply device. The ink passage 46 is connected to one end of an ink passage 54 disposed at the backside of the ink ejection part 44 of the print head through a connector cap 56 which will be described later. Further, the other connection opening 44*b* of the ink ejection part 44 is connected to one end of ink passage 48 as a first ink passage forming a part of construction of the liquid supply device.

The other end of the ink passage 48 is connected with an ink supply tube 34 of a joint holder 50 provided with the ink supply tube 34 and an ink supply/recovery tube 36, and the other end of the ink passage 54 is connected to the ink supply/recovery tube 36 of the joint holder 50. The lower end of the joint holder 50 is supported on a support member 38 through a bracket (not shown).

The joint holder 50 formed of Noryl resin has an opening 50*b* connected with the other end of the ink passage 48 and an opening 50*a* connected with the other end of the ink passage 54. Connection part of the ink passages 48 and 54 with the openings 50*a* and 50*b* is provided with a filter respectively which is a net-formed member having a predetermined mesh.

Here, to one end of the ink passage 54 and the other end of the ink passage 46, a connector cap 56 detachably formed as open/close means to one end of the ink passage 54 and the other end of the ink passage 46 is detachably connected. The connector cap 56 has a communication passage 56R for connecting the ink passages 46 and 54 with each other for both ink passages to function as a single ink passage, and has connection openings 56B and 56A connectable respectively with one end of the ink passage 54 and the other end of the ink passage 46.

The connector cap 56 is formed, for example, of Noryl resin. Its connection openings 56A and 56B are separated by a distance corresponding to the distance between one end of the ink passage 54 and the other end of the ink passage 46 and have the same shape. With this construction, when connecting one end of the ink passage 54 with the other end of the ink passage 46, the connector cap 56 can be connected in any mounting direction, thereby facilitating the production of the print head. The distance between one end of the ink passage 54 and the other end of the ink passage 46 is set to be the same as the distance between the other end of the ink passage 54 and one end of the ink passage 48, further, the outer diameters of the other end of the ink passage 54 and one end of the ink passage 48 are equal to each other.

With the above-described construction, the openings 50*a* and 50*b* of the joint holder 50 can be connected to one end of the ink passage 54 and the other end of the ink passage 46, and the connection openings 56A and 56B of the connector cap 56 can be connected to the other end of the ink passage 54 and one end of the ink passage 48.

With the above construction, since the joint holder 50 is connectable to any of one end of the ink passage 54 and the other end of the ink passage 46, and the other end of the ink passage 54 and one end of the ink passage 48, design flexibility of the piping system in the apparatus main body is increased, and structural design of the print head can be performed flexibly without being affected by the outer shape of the joint holder 50.

The connection openings 56A and 56B are respectively formed depressedly in the form of columns at parts opposing one end of the ink passage 54 and the other end of the ink passage 46. Further, the connection openings 56A and 56B are communicating with each other by the connection passage 56R for connecting the connection openings 56A and 56B. This communicates the ink passage 46 with the ink passage 54 as described above to form a single ink passage.

O-rings 58 having an inner diameter nearly equal to the outer diameter of the other end of the ink passage 54 and the ink passage 46 are provided in the inside of the connection openings 56A and 56B respectively. This makes the connector cap 56 detachable to the other end of the ink passage 54 and the ink passage 46 due to its elastic deformation. Further,.when the other end of the ink passage 54 and the ink passage 46 are inserted respectively into O-rings 58 of the connection openings 56A and 56B of the connector cap 56, the connection openings 56A and 56B are liquid-tightly sealed by the O-rings 58.

Therefore, a second ink passage of the liquid supply device is formed of the opening 50*a*, the ink passage 54, the communication passage 56R of the connector cap 56, and the ink passage 46.

The inner diameter of the ink passage 46 has a sufficiently larger opening diameter than that of the ink flow passage communicating with the ink ejection opening in the ink ejection part 44 (same for inner diameter of the ink passage 48) in order to ensure sufficiently ink supplying. With this construction, in the print head cleaning shown below, a large foreign matter existing in the common liquid chamber or the like can be effectively discharged to the outside.

As to cleaning of the inside of the print head constructed as above will be described in the following.

After being constructed as the ink-jet print head, first, to the preset cleaning position, the ink ejection part 44 is disposed at a lower position along the gravitational direction relative to the position where the connector cap 56 is disposed.

Next, with this state, the connector cap 56 communicating the ink passage 46 with the ink passage 54 is removed, a cleaning liquid (in the present example, a case using an ink is described, however, it is needless to say that a specified cleaning liquid may be used) is supplied along the direction shown by arrow K in FIG. 1. Therefore, the supplied ink is supplied to the ink ejection part 44 through the ink passage 48.

Next, portion of ink supplied to the ink ejection part 44 is discharged to the outside through its ink ejection opening, and remaining ink is discharged from the other end of the ink passage 46 to the outside.

By supplying ink as above, of foreign matter such as debris or the like existing in the the ink flow passage and the common liquid chamber of the ink ejection part 44, a foreign matter relatively smaller than opening diameter of the ink flow passage is mainly discharged to the outside from its ink ejection opening side. On the other hand, the above small foreign matter which was not discharged from its ink ejection opening and a foreign matter larger than the opening diameter of the ink flow passage inside the ink ejection part 44 are flowed inside the common liquid chamber of the ink ejection part 44 and separated from the above-described relatively small foreign matter and discharged from the other end of the ink passage 46 through the ink passage 46 having a sufficiently larger opening diameter than inner diameter of the ink flow passage.

After the completion of cleaning operation of the inside of the print head, the connector cap 56 is mounted on the other end of the ink passage 46 and one end of the ink passage 54 to form the second passage just described.

In the cleaning of the ink-jet print head inside, the following operation can be performed to improve reliability of cleaning even further.

That is, in the above-described construction the ink is used as a cleaning liquid to clean the inside of the print head, however, a configuration of using an exclusive cleaning liquid is preferable.

Further, when the ink or a cleaning liquid is supplied, a vibration applied to the entire print head is a very effective means to remove foreign matter.

By applying a vibration to the print head, foreign matter adhered to the ink flow passage wall of the print head is floated up into ink (cleaning liquid), and flowed with the flow of ink (cleaning liquid) from the inside of the print head. Therefore, the cleaning effect is improved.

When applying a vibration to the print head, the application may be performed in the state where ink (cleaning liquid) is filled in the print head with the connector cap 56 mounted. Further, vibration may be applied while flowing ink (cleaning liquid) with the connector cap 56 removed. When applying a vibration in the state with ink (cleaning liquid) filled in the print head, foreign matter can be efficiently floated up into ink (cleaning liquid) and efficiently peeled off from the wall surface of the ink flow passage. Further, when a vibration is applied to the print head while flowing ink (cleaning liquid), flow of ink (cleaning liquid) and vibration act synergistically to removal of foreign matter, thereby achieving sure removal and movement of foreign matter.

As a method of applying a vibration to the print head, various configurations, apparatus, or methods may be used as far as an unnecessary damage is not generated to the produced print head. As an example thereof, when an air cylinder or a stepping motor is used as vibration generation means, the application may be performed by tapping the substrate of the print head or a part of the support member with an intermediate for transmitting vibration from the vibration generation means.

As a variation of the type of flowing ink (cleaning liquid) in the print head, by flowing ink (cleaning liquid) and air alternately, it is effective for removal of a foreign matter to perform cleaning in the state that ink (cleaning liquid) and air are mixed alternately in the common liquid chamber or the like of the printing head. Action of ink (cleaning liquid) and air alternately to the wall forming the common liquid chamber or the ink flow passage facilitates effective action of vibration to a foreign matter. Therefore, it has an effect to promote removal of a foreign matter. Of course at this time, when this is performed while applying a vibration to the print head, even more effective removal of a foreign matter is possible.

Further, use of a configuration where ink (cleaning liquid) is sucked from the ink ejection opening of the print head to be positively discharged is effective because it assures removal of a foreign matter such as debris remained inside the ink flow passage of the print head.

The ink-jet print head with the inside cleaned as above is checked for non-ejection of ink, by making ejection of ink from all the ink ejection openings by a predetermined print inspection device.

In the inspection, a print head with normal ink ejection is mounted on the printing apparatus to be part of an ink-jet printing apparatus.

On the other hand, one which was not normal in ink ejection is removed again of the connector cap 56, and mounted on a predetermined cleaning apparatus to be cleaned. Therefore, cleaning of the inside of the print head can be simply performed and, as a result, measures are taken for eliminating the non-ejection state. This improves the yield in the production of the print head.

Figure 2:
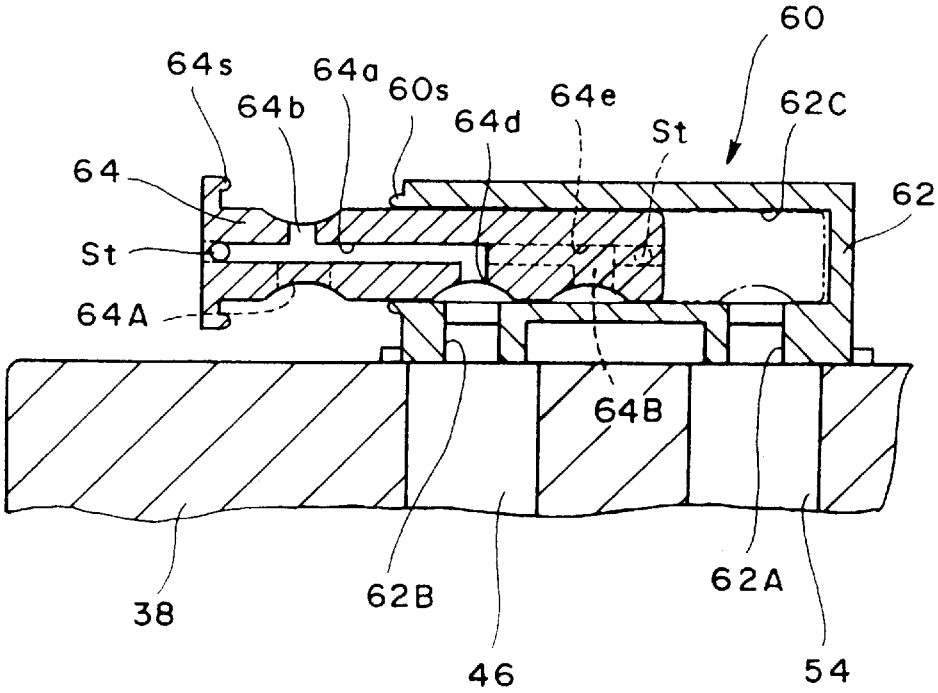
FIG. 2 is a sectional diagram showing another construction example of a connector cap of the ink-jet print head according to the present invention.
Figure 3:
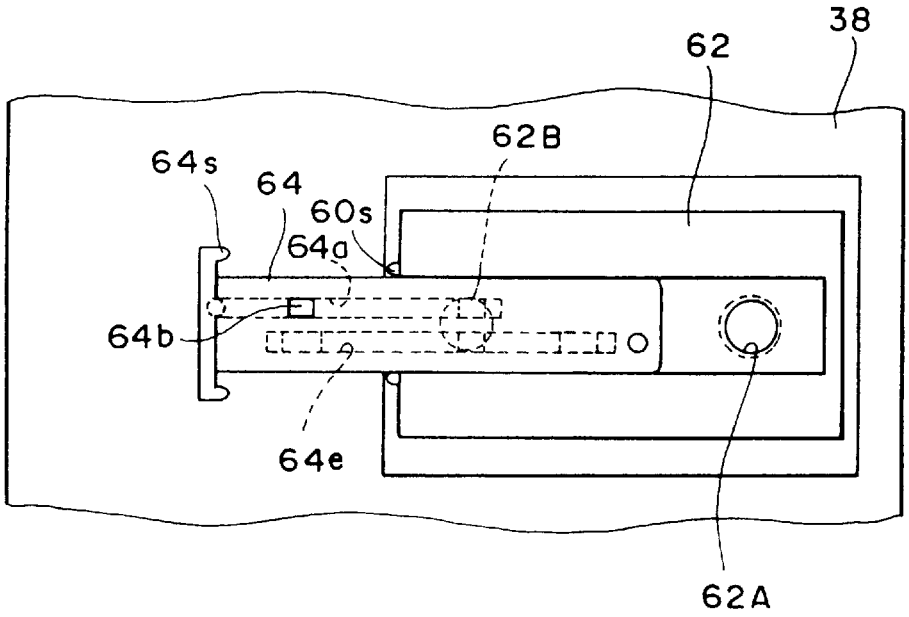
FIG. 3 is a plan view of the construction example shown in FIG. 2.
Figure 4:
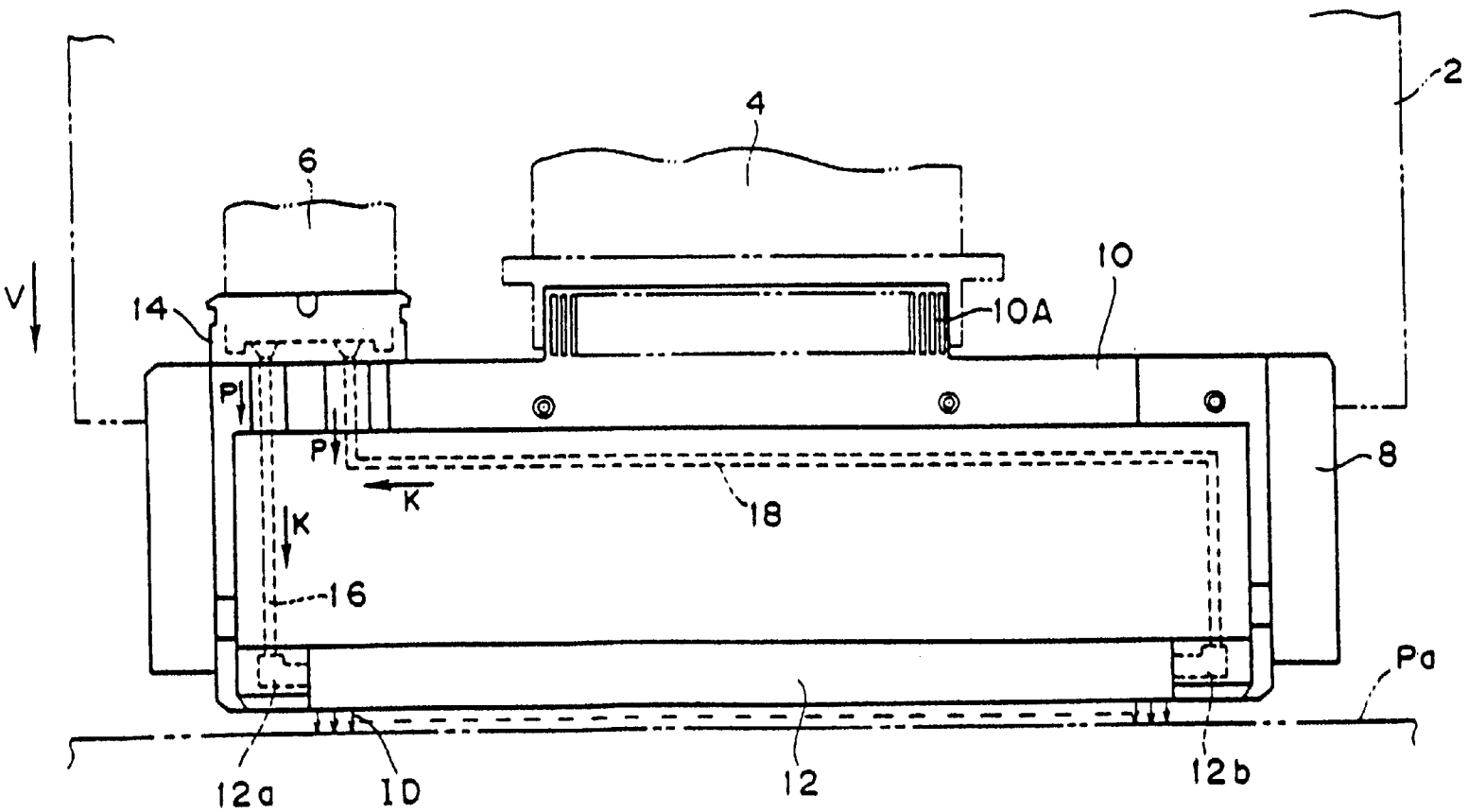
FIG. 4 PRIOR ART
FIG. 4 is a diagram showing the construction of a liquid supply device in a prior art print head.
Figure 5:
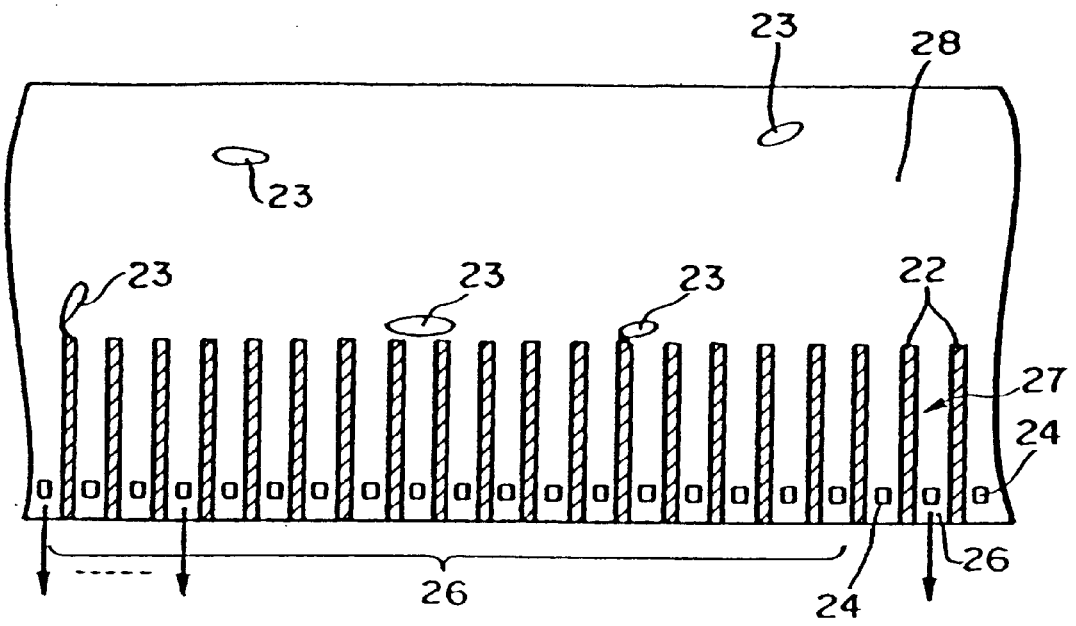
FIG. 5 PRIOR ART
FIG. 5 is a partial sectional diagram showing schematically the state where cutting debris or the like exist in the inside of an example of the prior art print head.
Figure 6:
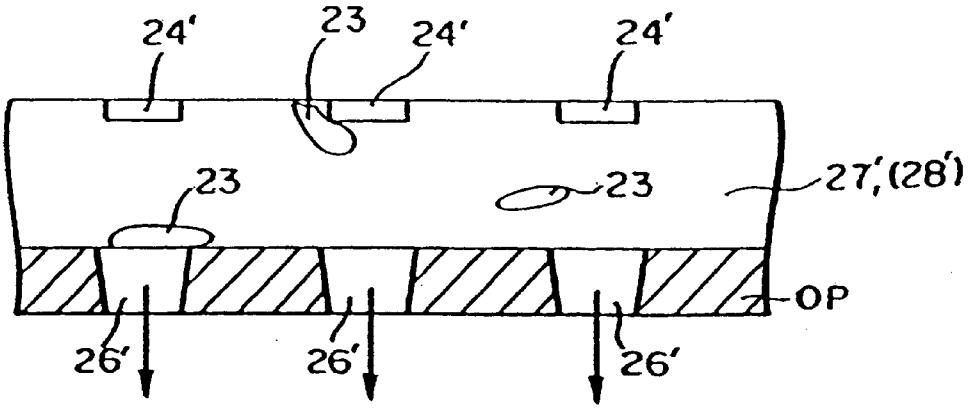
FIG. 6 PRIOR ART
FIG. 6 is a partial sectional diagram showing schematically the state where cutting debris or the like exist in the inside of another example of the prior art print head.
Figure 7:
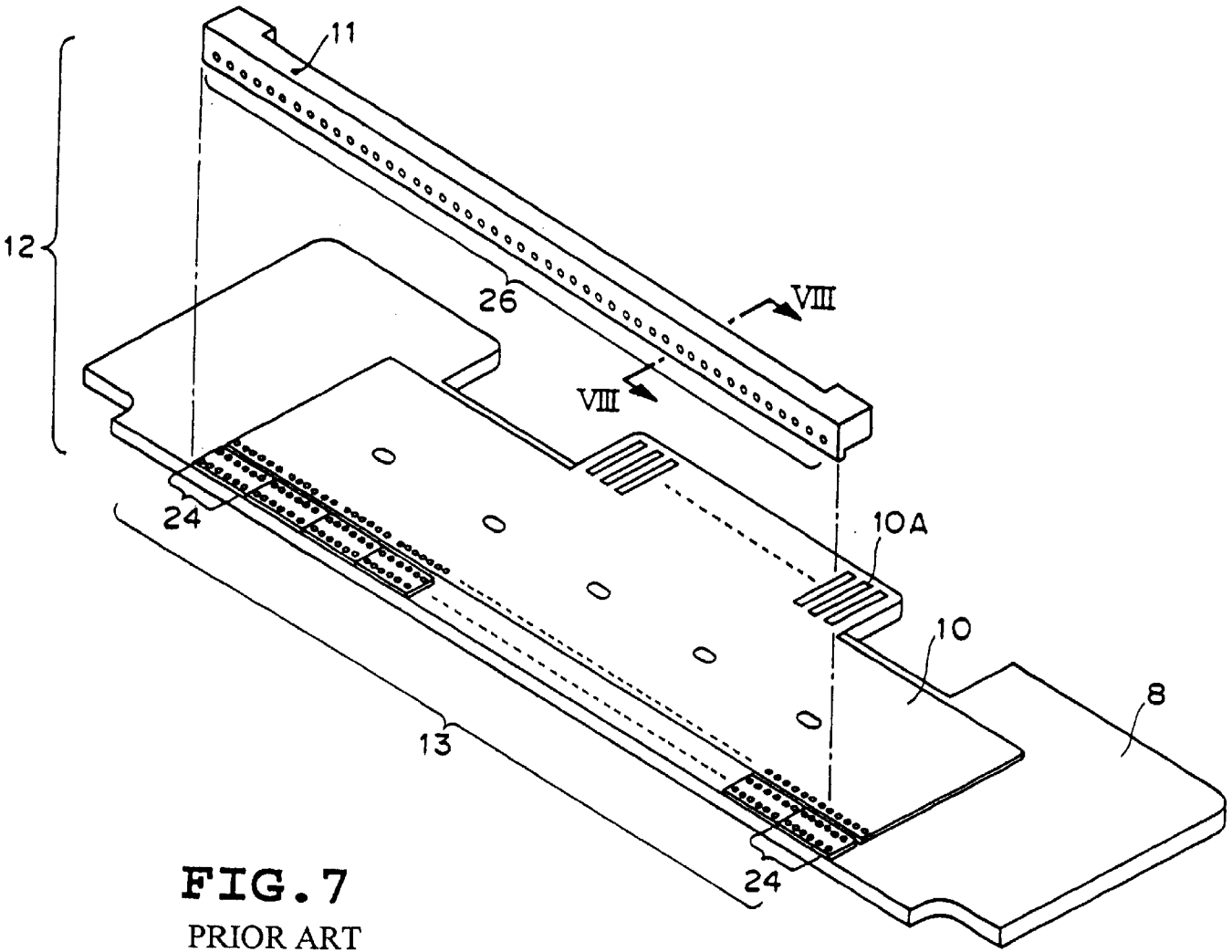
FIG. 7 PRIOR ART
FIG. 7 is an exploded perspective diagram showing schematically the construction of the prior art print head.
Figure 8:
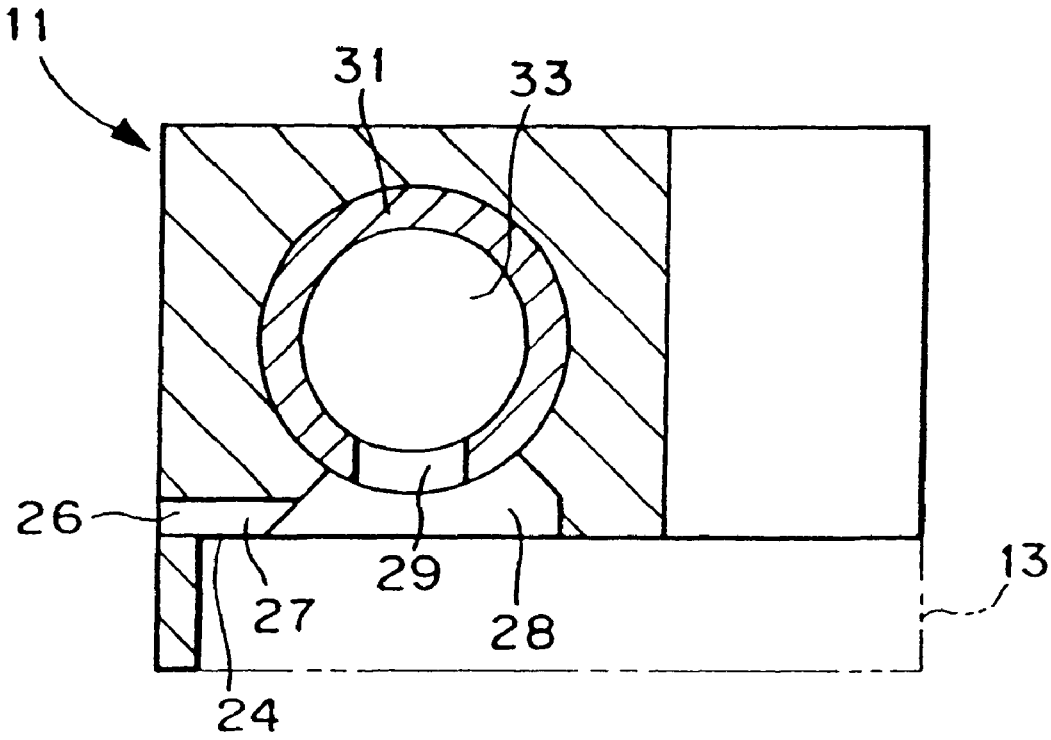
FIG. 8 PRIOR ART
FIG. 8 is a partial. sectional diagram taken along line VIII—VIII in the prior art print head shown in FIG. 7.

FIGS. 2 and 3 are diagrams showing part of another construction example of connector cap used in an example of print head according to the present invention. In FIGS. 2 and 3, the same components as those shown in FIG. 1 are indicated with the same reference numerals, and detailed description thereof is omitted. Other construction which is not shown is the same as the construction of the example shown in FIG. 1.

FIGS. 2 and 3 show a select valve 60 as open/close means eliminating its detachment operation used in place of the connector cap 56 shown in FIG. 1.

The select valve 60 comprises a valve main body case 62 having connection openings 62A and 62B connected respectively to the other end of the ink passage 46 and one end of the ink passage 54 and bonded to a support member 38, and a spool member 64 slidably supported on a containing chamber 62C in the valve main body case 62 for blocking communication state between the ink passages 46 and 54 with each other for selecting to discharge ink to the outside.

The valve main body case 62 is made, for example, of a stainless steel and has connection openings 62A and 62B opening to a surface being bonded cemented to the support member 38, respectively corresponding to the other ends of the ink passages 46 and 54. The connection openings 62A and 62B communicate with the containing chamber 62C. The whole peripheral part of opening end of the containing chamber 62C is provided with a sealing material 60S engaged with a sealing material 64S of the spool member 64, which will be described later, for cooperatively sealing the containing chamber 62C.

The spool member 64 has through-holes 64A and 64B, which when inserted to the position shown by the chain doubled-dashed line in FIG. 2, are respectively communicated with the connection openings 62A and 62B of the valve main body case 62. The through-holes 64A and 64B are linked by a communication passage 64*e* formed inside. One end of the communication passage 64*e* is closed by a stopper St.

Further, as shown in FIGS. 2 and 3, a discharge passage 64*a* is formed inside and in parallel to the communication passage 64*e*. One end of the discharge passage 64*a* is closed by a stopper St. Still further, at a position of the discharge passage 64*a* opposing the through-hole 64A, a through-hole 64*b* is formed for communicating the atmosphere with the inside of the discharge passage 64*a*. Yet further, at the other end of the discharge passage 64*a*, a through-hole 64*d* is provided which communicates with the connection opening 62B when, as shown in FIG. 2, the spool member 64 is pulled out to the outside by a predetermined amount with respect to the main body case 62.

Also in the above construction, when the spool member 64 is inserted to the position shown by the chain doubled-dashed line in FIG. 2, the above-described second passage is formed by the opening 50*a*, the ink passage 54, the communication passage 64*e*, and the ink passage 46.

Space between the through-hole 64*d* and the through holes 64A and 64B is communicated by a small spacing between the outer peripheral surface of the spool member 64 and an inner peripheral surface of the containing chamber 62C of the valve main body case 62, however, with ink of below a predetermined pressure, there is no danger that the ink flows out between the through-hole 64*d* and the through-holes 64A and 64B.

In the above example, the material of the spool member 64 is stainless steel as a metallic material, however, the present invention is not limited to this example, but the spool member 64 may be made of a resin or rubber material.

In the print head provided with the select valve 60 constructed as in the present example, when printing operation of the print head mounted on a predetermined position of the printing apparatus is performed, in the state that the spool member 64 is inserted into the containing chamber 62C of the valve main body case 62 to the position shown by the chain doubled-dashed line in FIG. 2, ink is supplied through the ink supply tube 34 and ink supply/recovery tube 36. By this operation, ink is supplied to the connection openings 44*a* and 44*b* of the ink ejection part 44 through both of the ink passage 48, ink passages 54 and 46.

Yet further, when recovery processing by preliminary ink ejection or suction in the ink ejection part 44 is performed, ink from the apparatus main body 30 is supplied through the ink supply tube 34. The ink supplied through the ink supply tube 34 is supplied to the ink ejection part 44 through the ink passage 48. Yet further, a portion of ink supplied to the ink ejection part 44 is discharged to the outside from the ejection opening, and remaining ink is recovered through the ink passage 46, the communication passage 64*e* of the spool member 64, the ink passage 54 and the ink supply/recovery tube 36.

In this case, when the spool member 64 is pulled out to the position shown by the solid line in FIG. 3 with respect to the containing chamber 62C of the valve main body case 62, a foreign matter such as dust which was not discharged from the ink ejection opening of the ink ejection part 44 and was moved is discharged to the outside through the through-hole 64*b*. At this moment, when a construction for recovering discharged ink is provided in the printing apparatus, staining of the inside of the apparatus is prevented.

An example of the present invention has been described with the print head of a type provided with a drive element in the ink passage of the ink ejection part 44 for ejecting ink along an extension direction of its ink flow passage, however, it is needless to say that an example of the present invention can be applied to a print head of a construction provided with an ejection opening in a direction opposing such a drive element.

Further, in an example of the present invention, the drive element is not limited to an electrothermal conversion element as in the above-described example, but the present invention can be effectively applied also to various constructions of print head including a type of ejecting ink utilizing an electromechanical conversion element and static electricity. Yet further, such a print head is not limited to one which ejects ink but may be one which ejects a treatment liquid for insolubilizing the ink.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. A production method of an ink-jet print head comprising a first passage provided with arranged liquid ejection openings for ejecting a liquid used for printing that communicates with one end of a liquid ejection part for conducting the liquid into said liquid ejection part, a second passage that communicates with another end of said liquid ejection part for supplying the liquid to said liquid ejection part or conducting the liquid in said liquid ejection part to the outside, and open/close means provided in said second passage for selectively communicating the inside of said second passage with the outside to discharge the liquid in said second passage to the outside, wherein said open/close means is detachable from two opening ends juxtaposed in said second passage, and when said open/close means is attached to said two opening ends a communication passage is formed for communicating said two opening ends with each other, said method comprising the steps of:

supplying the liquid from said first passage to said second passage;

discharging the liquid supplied to said second passage through said two opening ends by removing said open/close means from said two opening ends juxtaposed in said second passage; and attaching said open/close means to said two opening ends juxtaposed in said second passage after discharging the liquid supplied to said second passage, thereby forming a circulating route.

2. The production method of an ink-jet print head as claimed in claim 1, wherein said ink-jet print head further comprises an openable/closable port constructed to be put in an open state or a closed state by said open/close means, wherein, when discharging the liquid from said openable/closable port, said openable/closable port is in the open state.

3. The production method of an ink-jet print head as claimed in claim 2, wherein, after discharging the liquid from said openable/closable port, said openable/closable port is closed by said open/close means.

4. The production method of an ink-jet print head as claimed in claim 1, wherein during flow of the liquid, a vibration is applied to said ink-jet print head.

5. The production method of an ink-jet print head as claimed in claim 4, wherein said ink-jet print head further comprises an openable/closable port constructed to be put in an open state or a closed state by said open/close means, and wherein, when applying the vibration, said openable/closable port is in the closed state.

6. The production method of an ink-jet print head as claimed in claim 1, wherein said ink-jet print head further comprises an openable/closable port constructed to be put in an open state or a closed state by said open/close means, and wherein, during flow of the liquid, a vibration is applied to said ink-jet print head with said openable/closable port in the open state.

7. The production method of an ink-jet print head as claimed in claim 1, wherein foreign matter in a liquid flow passage is discharged to the outside by sucking from any of said ejection openings.

8. The production method of an ink-jet print head as claimed in claim 1, wherein said ink-jet print head further comprises an openable/closable port constructed to be put in an open state or a closed state by said open/close means, and wherein a liquid flowing operation is performed with said openable/closable port disposed above said ejection openings in a gravitational direction.

9. A production method of an ink-jet print head as claimed in claim 1, wherein, in said ink-jet head, an opening diameter of said first passage is larger than an opening diameter of said liquid ejection part, and an opening diameter of said second passage is larger than an opening diameter of said liquid ejection part.

10. An ink-jet print head comprising:

nozzles for ejecting an ink;

ink flow passages to each nozzle;

a common liquid chamber that communicates with said ink flow passages;

a first ink passage provided with a first filter at an end of a communication part that communicates with an end of said common liquid chamber;

a second ink passage provided with a second filter at an end of a communication part that communicates with another end of said common liquid chamber; and open/close means provided in said second ink passage for selectively communicating the inside of said second ink passage with the outside to discharge the liquid in said second ink passage to the outside, wherein said open/close means is detachable from two opening ends juxtaposed in said second ink passage, and when said open/close means is attached to said two opening ends a communication passage is formed for communicating said two opening ends with each other.

11. The ink-jet print head as claimed in claim 10, further comprising an openable/closable port constructed to be put in an open state or a closed state by said open/close means, wherein said second ink passage, from said communication part that communicates with said common liquid chamber to said second filter, is constructed with an openable/closable cap member mounted to said openable/closable port.

12. The ink-jet print head as claimed in claim 10, further comprising an openable/closable port constructed to be put in an open state or a closed state by said open/close means, wherein, during cleaning, said ink-jet print head is in a state in which said openable/closable port is disposed above said nozzles in a gravitational direction.

13. The ink-jet print head as claimed in claim 10, further comprising a drive element driven for ejecting the ink in an extension direction of one of said ink flow passages.

14. The ink-jet print head as claimed in claim 10, further comprising a drive element driven for ejecting the ink through an ejection opening opposite said drive element.

15. An ink-jet print head comprising:

a first passage provided with arranged liquid ejection openings for ejecting a liquid used for printing that communicates with one end of a liquid ejection part for conducting the liquid into said liquid ejection part;

a second passage that communicates with another end of said liquid ejection part for supplying the liquid to said liquid ejection part or conducting the liquid in said liquid ejection part to the outside; and open/close means provided in said second passage for selectively communicating the inside of said second passage with the outside to discharge the liquid in said second passage to the outside, wherein said open/close means is detachable from two opening ends juxtaposed in said second passage, and when said open/close means is attached to said two opening ends a communication passage is formed for communicating said two opening ends with each other.

16. The ink-jet print head as claimed in claim 15, wherein said open/close means includes a spool member having a discharge passage for discharging said liquid in said second passage to the outside, which, when moved relative to one of said two opening ends juxtaposed in said second passage, selectively communicates the inside of said second passage with the outside.

17. The ink-jet print head as claimed in claim 16, wherein said spool member includes a communication passage for communicating said two opening ends with each other when moved relatively.

18. The ink-jet print head as claimed in claim 15, wherein a shape of and a distance between respective ends of said first passage and said second passage are almost the same as a shape of and a distance between said two opening ends juxtaposed in said second passage.

19. The ink-jet print head as claimed in claim 15, wherein said first passage and said second passage are provided, respectively, with filters for removing foreign matter contained in the liquid.

20. The ink-jet print head as claimed in claim 15, wherein said open/close means is disposed between a filter and said liquid ejection part in said second passage.

21. The ink-jet print head as claimed in claim 15, wherein said open/close means is formed of a resin material, a metal material, or a rubber material.

22. The ink-jet print head as claimed in claim 21, wherein material forming said open/close means has a slight permeability to air.

23. The ink-jet print head as claimed in claim 15, wherein said liquid ejection openings of said liquid ejection part are formed in a plurality of units at predetermined intervals over an entire width of a printing area of a printing medium.

24. The ink-jet print head as claimed in claim 15, wherein said liquid ejection part is provided with electrothermal conversion elements in liquid flow passages respectively corresponding to said liquid ejection openings for heating the liquid to eject the liquid from said liquid ejection openings.

* * * * *

UNITED STATES PATENT AND TRADEMARK OFFICE

CERTIFICATE OF CORRECTION

PATENT NO. : 6,406,137 B1
DATED : June 18, 2002
INVENTOR(S) : Takeshi Okazaki et al.

It is certified that error appears in the above-identified patent and that said Letters Patent is hereby corrected as shown below:

Column 2,
Line 55, “at.” should read -- at --.

Column 4,
Line 52, “partial.” should read -- partial --.

Column 6,
Line 32, “Further,.” should read -- Further, --.

Column 7,
Line 4, “the” (third occurrence) should be deleted.

Column 10,
Line 20, “ing” should read -- ing: --.

Signed and Sealed this

Fourth Day of February, 2003

JAMES E. ROGAN
*Director of the United States Patent and Trademark Office*